US005996544A

United States Patent [19]

Bartos

[11] Patent Number: 5,996,544

[45] Date of Patent: Dec. 7, 1999

[54] ROTARY VALVE CONTROL SYSTEM FOR INTERNAL COMBUSTION ENGINES AND RECIPROCATING PUMPS

[76] Inventor: Franz Stanislav Bartos, Mundelsheim, Germany

[21] Appl. No.: 09/043,700

[22] PCT Filed: Sep. 26, 1996

[86] PCT No.: PCT/EP96/04194

§ 371 Date: Feb. 12, 1999

§ 102(e) Date: Feb. 12, 1999

[87] PCT Pub. No.: WO97/12128

PCT Pub. Date: Apr. 3, 1997

[30] Foreign Application Priority Data

Sep. 27, 1995 [DE] Germany ..... 195 35 920

[51] Int. Cl.[6] ..... F01L 7/08

[52] U.S. Cl. ..... 123/190.13; 123/190.14; 123/190.16; 123/190.17

[58] Field of Search ..... 123/190.1, 190.12, 123/190.13, 190.16, 190.4, 190.17, 188.6, 188.9, 190.14, 80 BB, 80 D, 80 DA

[56] References Cited

U.S. PATENT DOCUMENTS

| | | | |
|---|---|---|---|
| 1,996,200 | 4/1935 | Hall | 123/190.13 |
| 2,247,984 | 7/1941 | Densinger et al. | 123/80 D |
| 3,603,299 | 9/1971 | Lamperti | 123/190.13 |
| 4,418,658 | 12/1983 | DiRoss | 123/190.14 |
| 5,558,049 | 9/1996 | Dubose | 123/80 D |
| 5,673,663 | 10/1997 | Kim | 123/190.14 |

FOREIGN PATENT DOCUMENTS

| | | |
|---|---|---|
| 911 791 | 5/1954 | Germany . |
| 43 12 492 A1 | 10/1994 | Germany . |

*Primary Examiner*—Thomas N. Moulis
*Attorney, Agent, or Firm*—Michael J. Striker

[57] ABSTRACT

The invention relates to a rotary valve control system for internal combustion engines and reciprocating pumps. A rotationally symmetrical, dome-shaped, drivable rotary valve is arranged in the cylinder head of the engine. In the cylinder head there is in the region of the inlet duct and the outlet duct at least one rotatable gasket ring which is provided with a drive. The rotary valve is linked to the drive thereof by means of spring means acting in the peripheral direction, and the gasket rings are in the form of thrust bearings and arranged on that side of the rotary valve which faces away from the cylinder.

3 Claims, 1 Drawing Sheet

Figure 1:
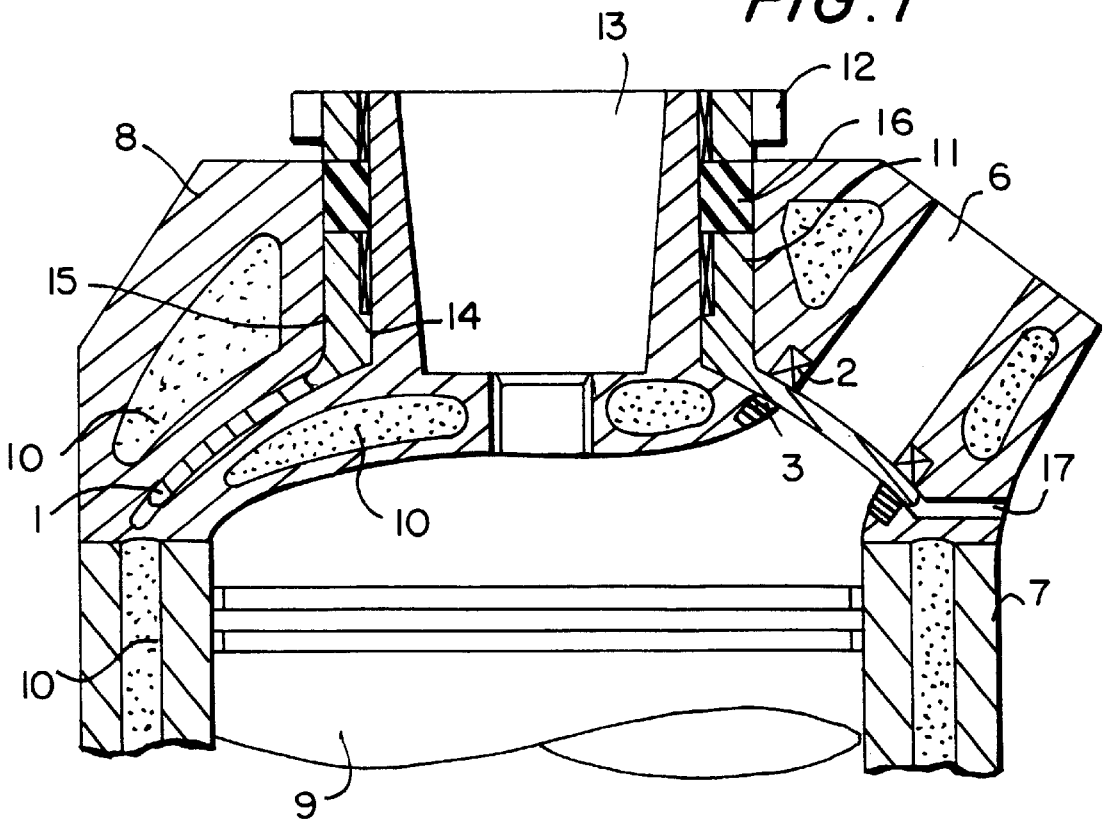

ROTARY VALVE CONTROL SYSTEM FOR INTERNAL COMBUSTION ENGINES AND RECIPROCATING PUMPS

The invention relates to a rotary valve control for internal combustion engines and reciprocating pumps, having a cylinder head, in which a dynamically balanced cup-shaped rotary valve which is coupled with a drive, is arranged to be rotatable around the cylinder shaft, and at least one inlet conduit and at least one outlet conduit are provided in the cylinder head, and a control opening, which corresponds with the inlet conduit, or respectively the outlet conduit, is provided in the rotary valve, wherein a freely rotatable seal ring is provided in the area of the inlet conduit and the outlet conduit at least on the side of the rotary valve facing the cylinder, the rotary valve is centrally driven and the cylinder head and the cylinder are provided with cooling conduits on both sides of the rotary valve.

Such a rotary valve control is known (DE-A-43 12 492).

Another rotary valve control is known (DE-PS-911 791). In this known rotary valve control the rotary valve is provided with teeth on the edge, which are in engagement with a pinion gear arranged at the end of a shaft. Furthermore, the cylinder head, and therefore the rotary valve, are cooled by cooling ribs arranged on the exterior of the cylinder head.

This known rotary valve control has the disadvantage that the rotary valve does not have sufficient sealing, required for a long service life, in respect to the openings in the cylinder head. Furthermore, cooling of the rotary valve does not appear to be sufficient.

The technical problem on which the invention is based therefore consists in improving the known rotary valve control mentioned at the outset in respect to its dependability, load-carrying ability, service life and economy.

This technical problem is solved by the invention in that a. the rotary valve is coupled with the drive by means of the interposition of a spring device acting in the circumferential direction, b. the rotatable seal rings are coupled with a drive, c. the seal rings, which are arranged on the side of the rotary valve facing away from the cylinder, are embodied as an axial bearing, d. the seal rings are provided with lubrication and cooling.

The rotatable seal rings have a multiple function in the solution in accordance with the invention. Because now they are continuously driven mechanically, or preferably hydraulically, independent of the rotation of the rotary valve, they are simultaneously lubricated and cooled.

The seal rings on the exterior, i.e. the side of the rotary valve facing away from the cylinder, not only seal the rotary valve in respect to the inlet and outlet conduits, but also act as axial bearings for damping the pressure forces generated by the piston and acting on the rotary valve.

The seal rings acting as axial bearings also prevent the possible vibration of the rotary valve during load changes in the course of the operation of the device. This simultaneously permits a reduction of the wall thickness of the rotary valve, so that less heat is stored in it and the centrifugal forces caused by their mass are reduced.

The spring device inserted into the drive of the rotary valve, which acts in the direction of rotation and can act mechanically or hydraulically, permits a fluctuation of the circular velocity of the rotary valve. Such a fluctuation is caused, for example, by the changing pressure conditions in the cylinder. The rotary movement of the rotary valve is evened out by the resilient drive of the rotary valve, and shock-like loads of the drive system are prevented.

If required, the spring unit can also be designed with springs, whose spring characteristics can be controlled in order to match the engine characteristic—for example when employed in an internal combustion engine—to the requirements and to be able to achieve a higher torque, for example.

Figure 2:
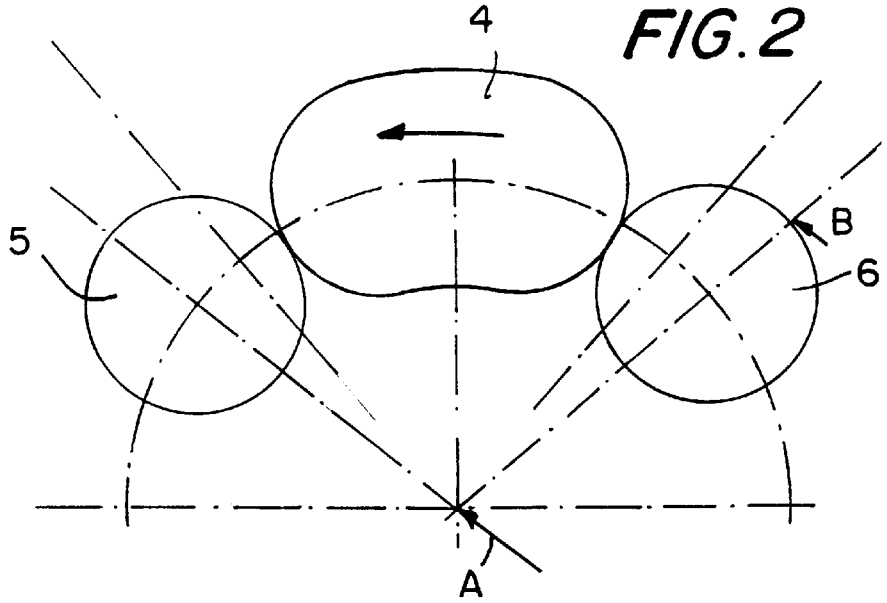

Advantageous details of the invention are contained in FIGS. 2 and 3. It will be explained below by means of an exemplary embodiment represented in FIGS. 1 and 2. Shown are in:

FIG. 1, a longitudinal section along the line AB in FIG. 2 of an exemplary embodiment of the device in accordance with the invention and FIG. 2, schematically the arrangement of the openings in the cylinder head and rotary valve of the device in accordance with FIG. 1.

The cylinder 7 with the piston 9 arranged therein and the cylinder head 8 can be seen in FIG. 1. The cylinder head 8 and the cylinder 7 have cavities 10 for receiving a coolant. The rotary valve 1, which is provided with a collar 11, is arranged in an appropriately designed cavity between the cylinder 7 and the cylinder head 8. The upper end of the collar 11 is frictionally connected with a drive wheel 12. The center part of the cylinder head 8 has a cup-shaped depression 13, in whose bottom an opening for receiving an ignition device, for example a spark plug, is provided. The spring device 16 is inserted between the drive wheel 12 and the collar 11.

The outlet conduit 6, which is sealed toward the rotary valve 1 by rotatable seal rings 2 and 3, can be seen in the cylinder head 8. Seal rings 14 and 15 are also provided for sealing the collar 11 against the cylinder 7 and the cylinder head 8.

As can be seen from FIG. 1, a circumferential conduit, which is connected via the opening 17 with the outside air, is provided in the cylinder head 8 in the area of the outer edge of the rotary valve 1.

The seal rings 3 are simultaneously designed as axial bearings, so that they damp the forces of compression acting on the rotary valve. If a spring device 16 is employed, which can be controlled during the operation of the device, the exhaust stroke of the device can be affected. By means of this it is possible to match the operating characteristics and to achieve a higher torque, for example.

FIG. 2 shows an instantaneous relative position of the opening 4 in the rotary valve 1 in respect to the inlet conduit 5 and the outlet conduit 6 in the cylinder head 8 in a defined rotary position of the rotary valve 1.

The rotary valve 1 is arranged centered in respect to the cylinder head. The cylinder 7 and the cylinder head 8, and therefore also the rotary valve 1, are cooled by means of the coolant contained in the cavities 10. The surfaces of the cylinder head 8 and the cylinder 7 facing the rotary slide 1 have been adapted to the cup shape of the rotary valve 1. Satisfactory cooling of the rotary valve also takes place because of the close contact between the rotary valve and the cooled cylinder head 8 and cylinder 7 provided by this.

The rotary seal rings 2 and 3, which—as represented—have been installed on both sides of the inlet and outlet conduit, provide the required sealing during operation. However, the seal rings can also be provided only on one side. The rotatable seal rings 2, 3 sliding on the spherical surface of the rotary valve 1 constitute an important advantage of the device.

Further advantages of the proposed solution are: the degree of compression is not limited by a glowing valve. The flow in the inlet and outlet conduits is improved by approximately 40% in comparison to inlet and outlet openings operated by valves. No output loss caused by valve springs occurs. The rpm limit is displaced toward higher rpm. The engine runs more evenly and quietly. The improved utilization of the fuel leads to careful treatment of the environment.

I claim:

1. A rotary valve control for internal combustion engines and reciprocating pumps, having a cylinder head, in which a dynamically balanced cup-shaped rotary valve which is coupled with a drive, is arranged to be rotatable around the cylinder shaft, and at least one inlet conduit and at least one outlet conduit are provided in the cylinder head, and a control opening, which corresponds with the inlet conduit, or respectively the outlet conduit, is provided in the rotary valve, wherein a freely rotatable seal ring is provided in the area of the inlet conduit and the outlet conduit at least on the side of the rotary valve facing the cylinder, the rotary valve is centrally driven and the cylinder head and the cylinder are provided with cooling conduits on both sides of the rotary valve, characterized in that a. the rotary valve (1) is coupled with the drive by means of the interposition of a spring device (16) acting in the circumferential direction, b. the rotatable seal rings (2, 3) are coupled with a drive, c. the seal rings (2), which are arranged on the side of the rotary valve facing away from the cylinder (7), are embodied as an axial bearing, d. the seal rings (2, 3) are provided with lubrication and cooling.

2. The rotary valve control in accordance with claim 1, characterized in that seal rings (14, 15) are provided between the collar (11) of the rotary valve (1) and the cylinder head (7).

3. The rotary valve control in accordance with claim 1, characterized in that a circumferential conduit, which is connected with the outside air via at least one opening (17), is provided in the cylinder head (8) in the area of the outer edge of the rotary valve (1).

* * * * *